US005431193A

United States Patent [19]

Mood et al.

[11] Patent Number: 5,431,193

[45] Date of Patent: Jul. 11, 1995

[54] MULTI-AXIAL WEAVING WITH TWO PART REED AND TRAVERSING WARPS

[75] Inventors: Geoffrey I. Mood, Whitley Bay; Malcolm G. B. Mahboubian-Jones, Belmont, both of England

[73] Assignee: Short Brothers PLC, Belfast, Northern Ireland

[21] Appl. No.: 104,114

[22] PCT Filed: Feb. 12, 1992

[86] PCT No.: PCT/GB92/00247

§ 371 Date: Aug. 13, 1993

§ 102(e) Date: Aug. 13, 1993

[87] PCT Pub. No.: WO92/14876

PCT Pub. Date: Sep. 3, 1992

[30] Foreign Application Priority Data

Feb. 15, 1991 [GB] United Kingdom ..... 9103218

[51] Int. Cl.[6] ..... D03D 13/00; D03D 41/00; D03D 25/00

[52] U.S. Cl. ..... 139/11; 139/192; 139/48; 139/35; 139/DIG. 1

[58] Field of Search ..... 139/11, 192, DIG. 1, 139/48, 35, 50

[56] References Cited

U.S. PATENT DOCUMENTS 4,140,156 2/1979 Trost ..... 139/DIG. 1 X
5,137,058 8/1992 Anahara et al. ..... 139/DIG. 1

FOREIGN PATENT DOCUMENTS 2319822 10/1973 Germany .

OTHER PUBLICATIONS

*Textile Research Journal*, vol. 40, No. 11, 1 Nov. 1970, pp. 986–998, Norris, F. Dow, "Preliminary Investigations of Feasibility of Weaving Triaxial Fabrics (Doweave)".

*Primary Examiner*—Andrew M. Falik
*Attorney, Agent, or Firm*—Kenyon & Kenyon

[57] ABSTRACT

A process for weaving using a reed having vertically aligned upper and lower reed portions with the reed portions being relatively movable in a weft direction. The process includes transferring warp yarns between the reed portions, moving the transferred warp yarns in the weft direction to define a selected array of warp yarns, and then shedding the array of warp yarns for insertion of weft yarn. A weaving loom head is also provided including a reed having vertically aligned upper and lower reed portions, a plurality of healds each releasably engagable with an individual warp yarn for moving selected warp yarns from one reed portion to the other, and a selectively operable drive mechanism for causing relative movement between the reed portions by a predetermined spacing in the weft direction. Weaves may accordingly be produced including warp threads extending parallel to and/or inclined to the fabric take-off direction. Inclination of the warp threads may be in a horizontal and/or vertical plane. The warp yarns are woven with weft yarns that may extend in a direction generally perpendicular to the take-off direction and/or may be inclined in horizontal and/or vertical plane. Also, complex weaves may be produced wherein the weave pattern can be selectively changed as the weaving process progresses.

15 Claims, 8 Drawing Sheets

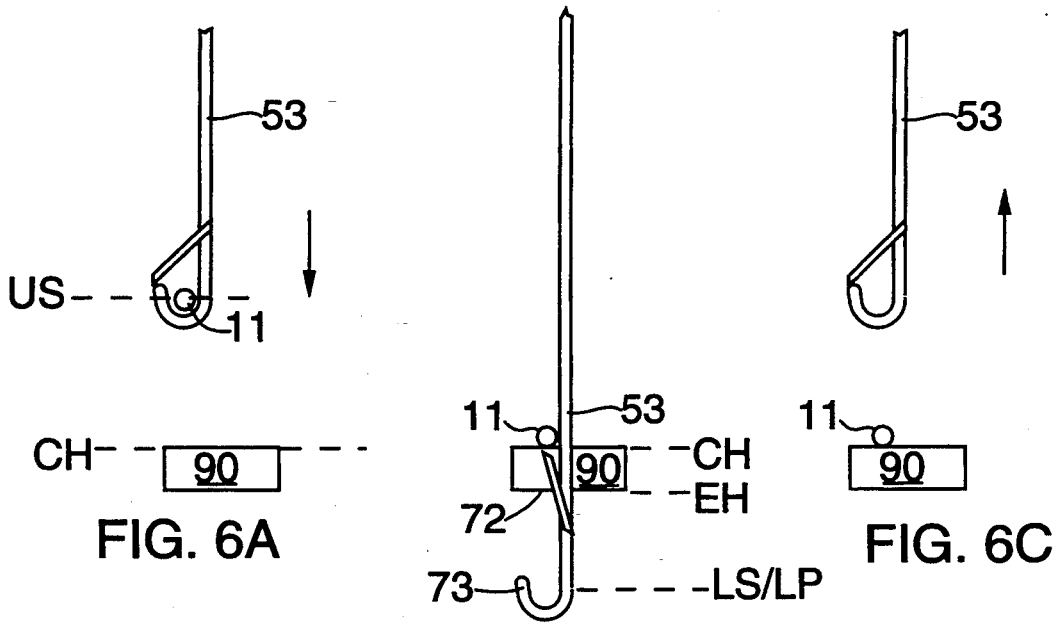
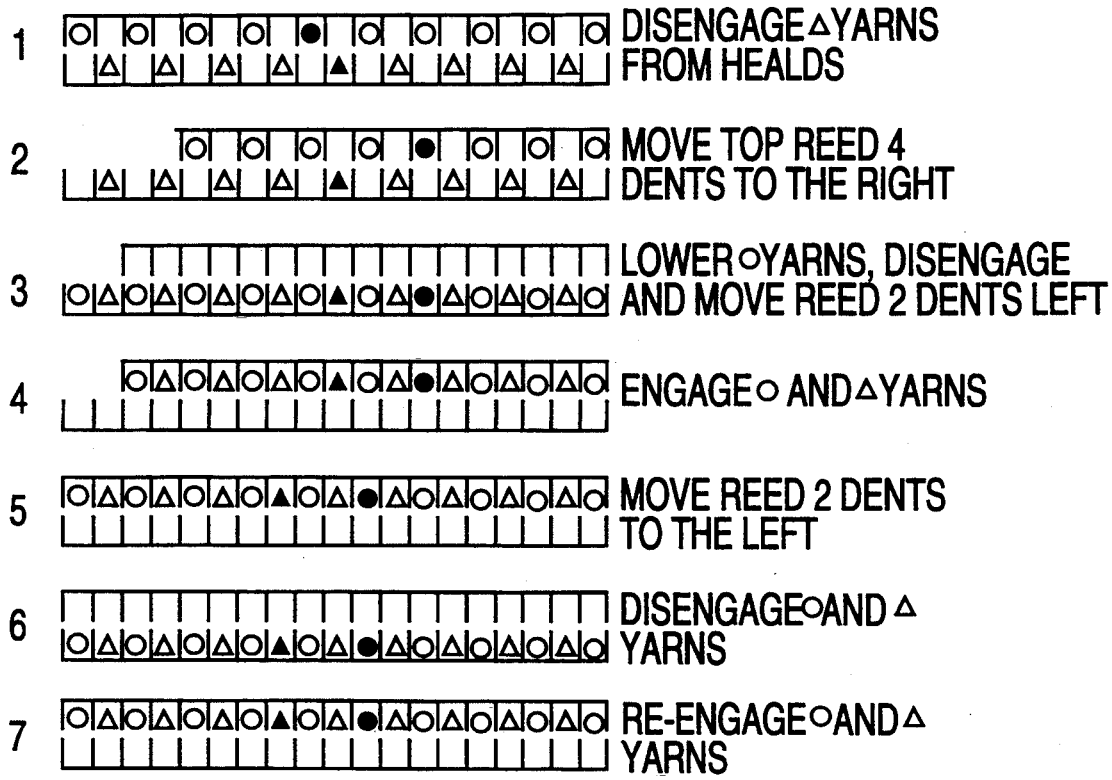
FIG. 7

MULTI-AXIAL WEAVING WITH TWO PART REED AND TRAVERSING WARPS

FIELD OF THE INVENTION

The present invention relates to a process and loom for weaving multi-axial woven fabric, and to fabric produced by the process.

BACKGROUND OF THE INVENTION

Multi-axial woven fabric is used as reinforcement in producing constructional components. The strength requirements of a composite component varies throughout its structure and so the fabric used has to be tailored for each component. This commonly involves accurately cutting the fabric to size and layering it where required to provide a three dimensional structure. Delamination between these layers can occur thereby weakening the component and so it is desirable for the independently formed layers to be physically tied to one another to provide inter layer strength.

A general aim of the present invention is to provide a process and loom weaving head for producing weaves including warp threads extending parallel to and/or inclined to the fabric take-off direction. Inclination of the warp threads may be in a horizontal and/or vertical plane. The warp yarns are woven with weft yarns which may extend in a direction generally perpendicular to the take-off direction and/or may be inclined in a horizontal and/or vertical plane.

In U.S. Pat. No. 4,140,156 a triaxial fabric is produced on a machine in which the two sets of bias yarns are created by displacement of heddles in the weftwise direction under the control of shifting means. Two sets of beating means that include opposing reeds are employed for beating up weft yarns to the fell of the fabric. The large number of heddles required need however to be movable weftwise, which leads to a machine of complex form.

A further aim of the invention is to provide a process and loom weaving head in which the formation of bias yarns in the weaving process can be advantageously carried out using novel yarn transfer means.

A further aim is to provide such a process and loom weaving head to enable complex weaves to be produced wherein the weave pattern can be selectively changed as the weaving process progresses. It is therefore possible to tailor the weave in order to provide desired shapes and/or strength characteristics.

SUMMARY OF THE INVENTION

According to one aspect of the present invention there is provided a process for weaving using a reed having vertically aligned upper and lower reed portions, the reed portions being relatively movable in the weft direction, the process including the steps of transferring warp yarns between said reed portions and moving the transferred warp yarns in the weft direction to define a selected array of warp yarns and then shedding the array of warp yarns for insertion of weft yarn.

Preferably one of said reed portions is stationary and the other is movable in the weft direction and definition of a selected array of warp yarns is achieved by moving selected individual warp yarns from a given dent in the stationary reed portion into the movable reed portion, moving the movable reed portion in the weft direction by a predetermined spacing and then returning the selected individual warp yarns to a different dent in the stationary reed portion. This sequence is repeated until a desired array of warp yarns is achieved.

Moving of the individual warp yarns between the stationary and movable reed portions is achieved using individual healds adapted for releasable engagement with individual warp yarns.

According to another aspect of the present invention there is provided a weaving loom head including a reed having vertically aligned upper and lower reed portions, the reed portions being relatively movable in the weft direction, a plurality of healds each of which is releasably engagable with an individual warp yarn and are arranged for moving selected warp yarns from one reed portion to the other reed portion and selectively operable drive means for causing relative movement between the reed portions by a predetermined spacing in the weft direction.

According to another aspect of the present invention there is provided woven fabric produced by the above defined process.

BRIEF DESCRIPTION OF THE DRAWINGS

Various aspects of the present invention are hereinafter described with reference to the accompanying drawings, in which:

FIGS. 6A, 6B and 6C are diagrammatic illustrations showing disengagement of a warp yarn;

FIG. 7 is a sequence illustrating how warp yarns are moved to provide a predefined array of warp yarns;

DETAILED DESCRIPTION

Figure 1:
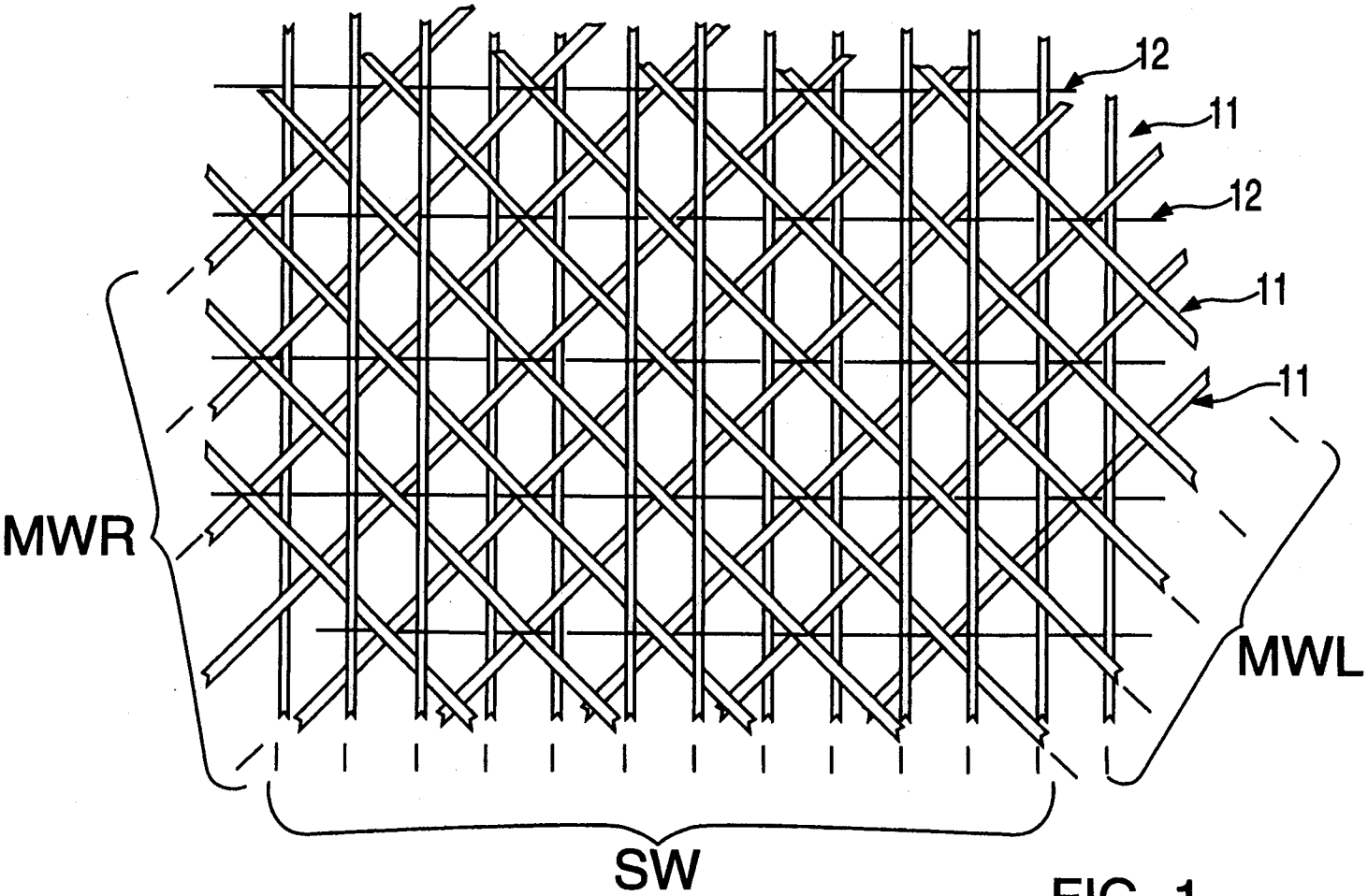
FIG. 1 is a schematic plan view of a tetra-axial weave.
Figure 2:
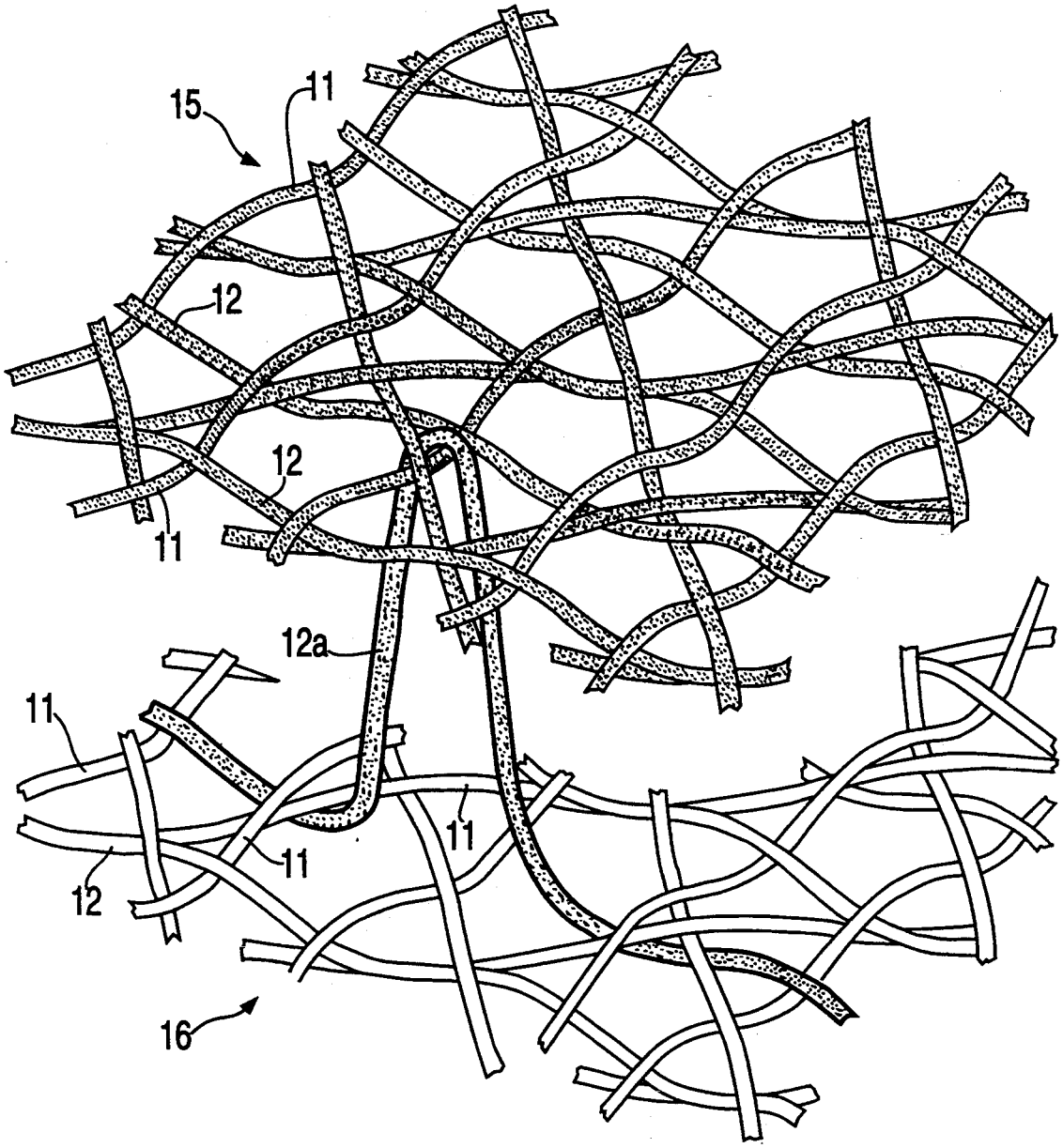
FIG. 2 is a schematic part perspective view of two layers of the tetra-axial weave of FIG. 1 joined by a weft yarn.
Figure 3:
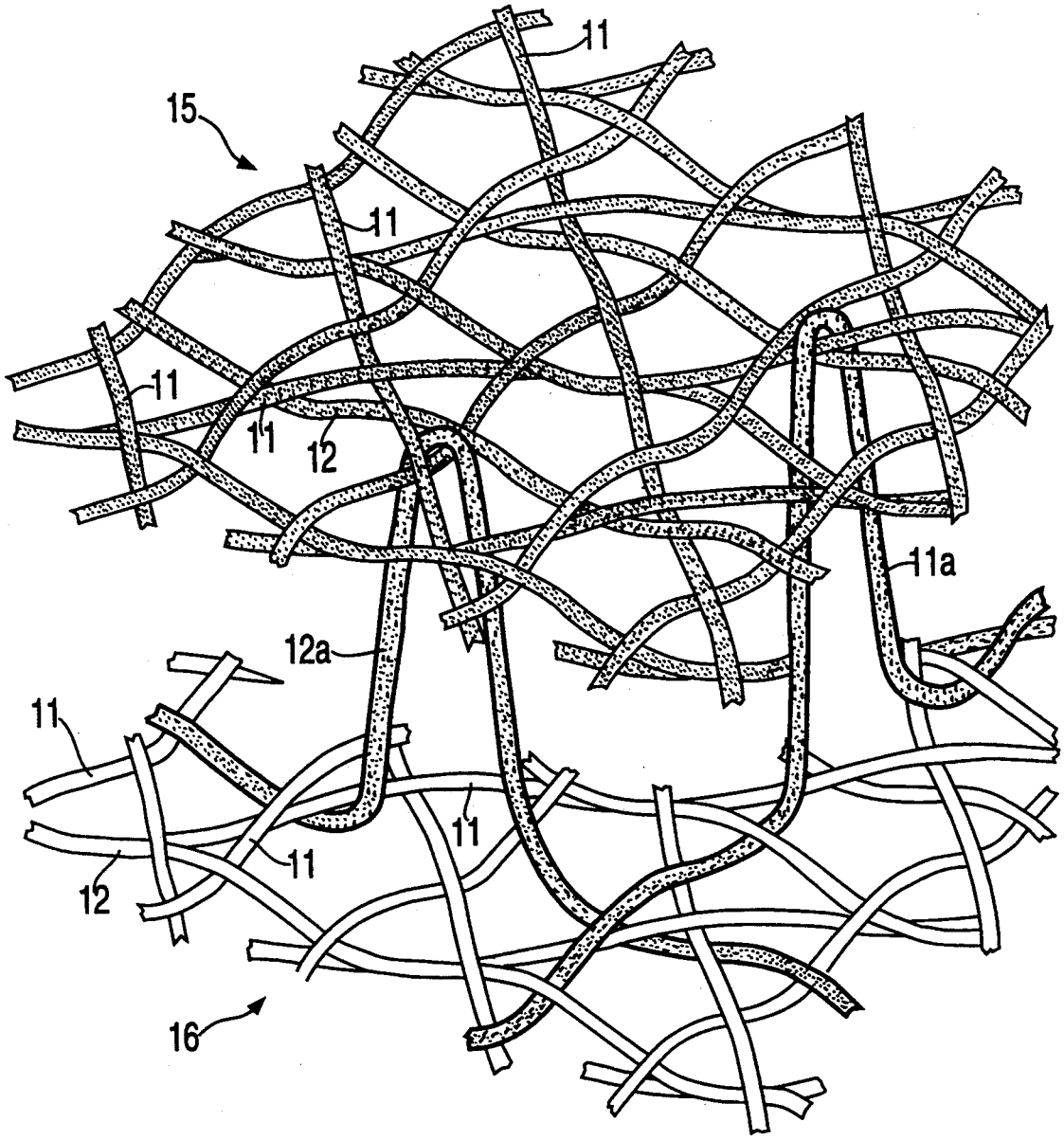
FIG. 3 is a schematic part perspective view of two layers of the tetra-axial weave of FIG. 1 joined by a weft yarn and a warp yarn.

Referring initially to FIGS. 1 to 3, there is illustrated in FIG. 1 a tetra-axial weave 10 composed of warp yarns 11 and weft yarns 12. A group of warp yarns (SW) are located at 90° to the weft yarns, a group of warp yarns (MWL) are located at 45° to the left of the weft direction and a group of warp yarns (MWR) are located at 45° to the right of the weft direction.

The fabric weave illustrated in FIG. 1 is a single layer fabric. In FIGS. 2 and 3 there is illustrated a two layered fabric having upper and lower fabric layers 15,16 respectively composed of the weave illustrated in FIG. 1. In FIG. 2 the upper and lower layers 15,16 are shown as being connected by a weft yarn 12*a* wherein in FIG. 3 the upper and lower layers are shown as being connected by a weft yarn 12*a* and a warp yarn 11*a*. The strength of the inter-layer connection can be varied by increasing/decreasing the number of sites of the warp 11*a* and/or weft 12*a* yarn connections.

A process and loom according to the present invention for producing the fabric weaves illustrated in FIGS. 1 to 3 will now be described with reference to FIGS. 4 to 9.

Figure 4:
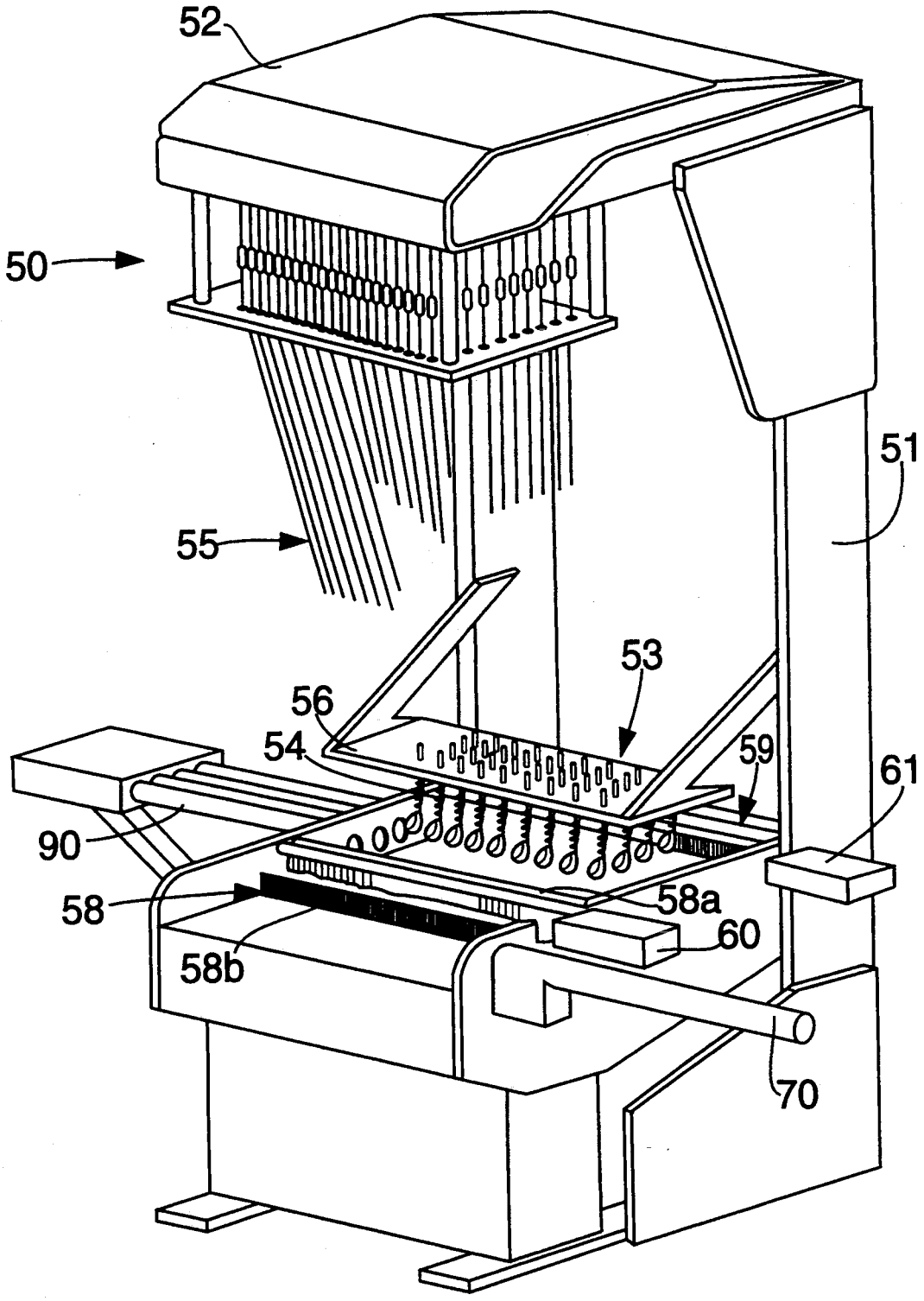
FIG. 4 is a schematic perspective view of a loom according to the present invention.
Figure 5:
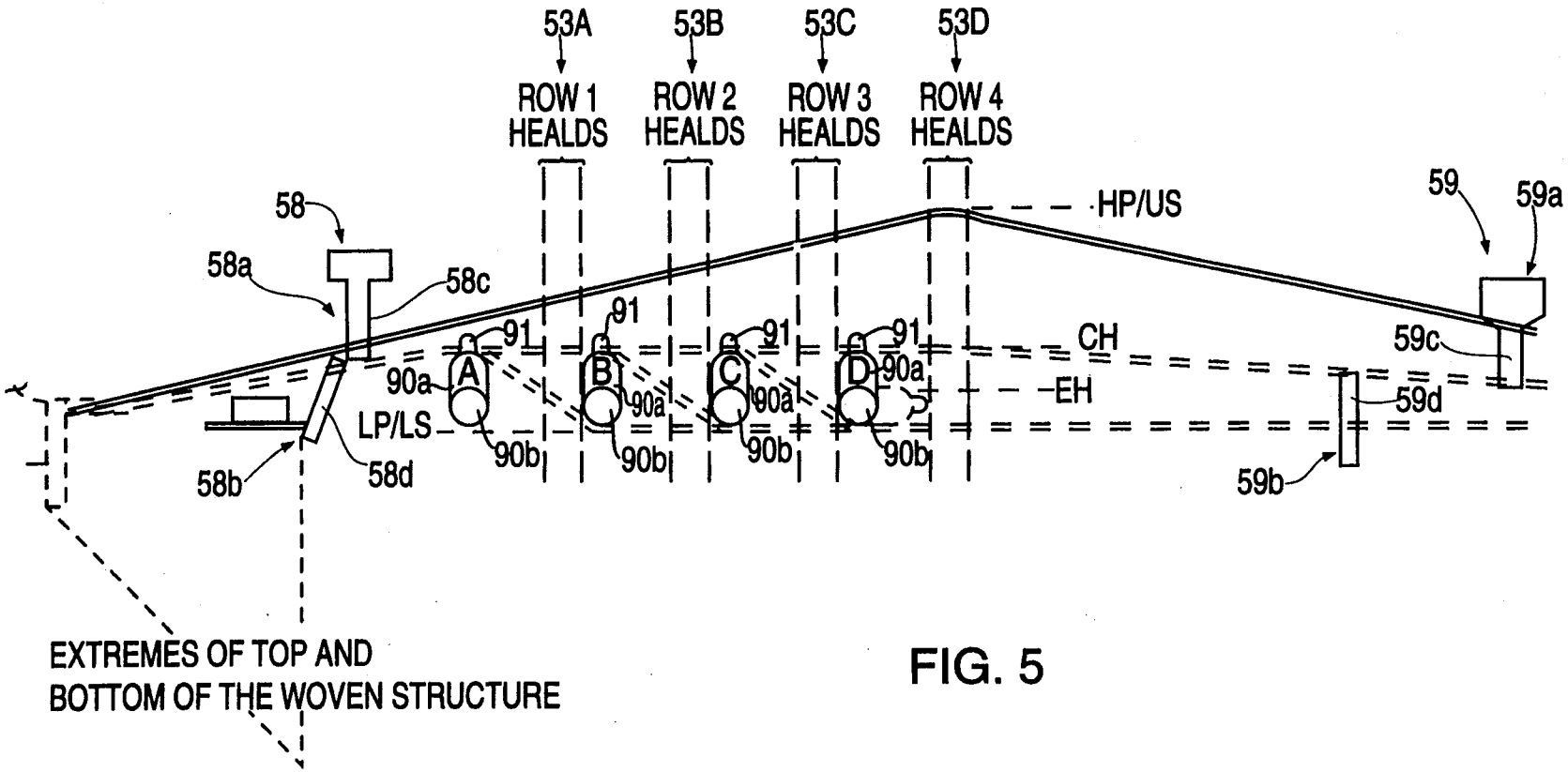
FIG. 5 is a diagrammatic lay-out of the loom of FIG. 4 when viewed from one side.
Figure 8:
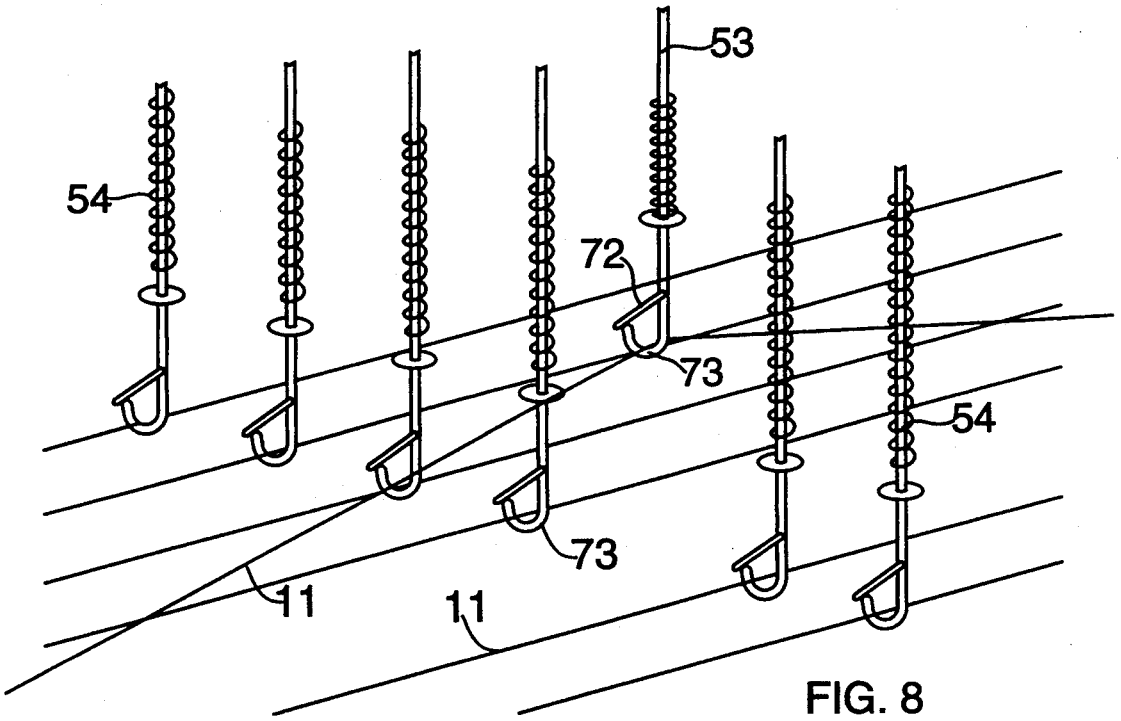
FIG. 8 is a schematic illustration of the creation of a shed.

In FIGS. 4 and 5 there is illustrated a loom 50 including a loom frame 51 on which is supported an electronic jacquard mechanism 52 for controlling raising and lowering of individual healds 53. Each individual heald 53 is slidably supported in a respective bore formed in a support platform 56 which is mounted on the loom frame 51. Each heald 53 is biased in a downwards direction by a spring 54 and is connected to the jacquard mechanism 52 by a harness 55.

The loom 50 further includes front and rear reed assemblies 58 and 59 respectively through which warp yarns pass. Each reed assembly 58,59 has an upper reed portion 58*a*,59*a* and a lower reed portion 58*b*,59*b* respectively. The upper reed portions 58*a*,59*a* are mounted so as to be displaceable in the weft direction whereas the lower reed portions 58*b*,59*b* are mounted so as to be fixed in the weft direction.

Accordingly, in order to permit relative lateral displacement between the upper and lower reed portions, the upper and lower reed portions 58*a*,58*b* and 59*a*,59*c* are offset in the warp feed direction so as to be spaced apart. The upper reed fingers 58*c*,59*c* (see FIG. 5) overlap in the vertical direction with the lower reed fingers 58*d*,59*d* respectively such that the dents defined between adjacent fingers in the upper and lower reed portions are continuous in the vertical direction.

Electronically controlled drive means 60,61 are provided for displacing the upper reed portions 58*a*,59*a* in synchronism in the weft direction by a predetermined spacing in response to a patterning control as will be discussed later. The warp yarns extending between the front and rear reed assemblies 58,59 are thereby maintained in a parallel relationship.

Weft insertion means 70, for example a rapier, is mounted on the loom frame 51 in front of the front reed assembly 58. The lower front reed portion 58*b* is preferably mounted for displacement in the warp feed direction so as to function as a beat-up means. It will be appreciated, however, that a separate alternative beat-up means may be provided if desired. The front reed portion 58*b* may be mounted for linear displacement in the warp direction and be driven by for example a linear motor, or it may be mounted on a rotatably mounted beat-up shaft as shown schematically in FIG. 5 which oscillates through a fixed angle.

Figure 10:
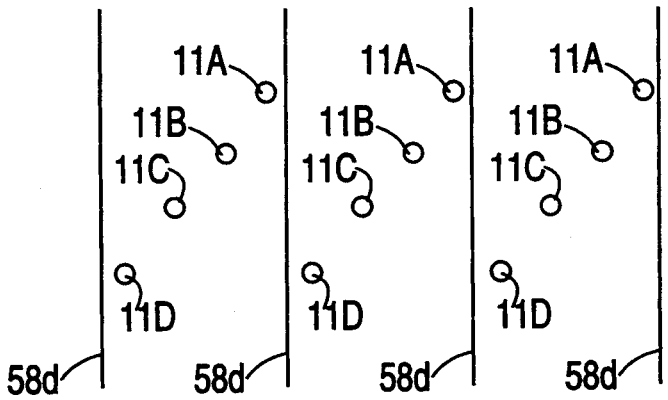
FIG. 10 is a schematic view showing a plurality of warp yarns in each dent of the reed assemblies.

For a single layer weave as illustrated in FIG. 1, warp yarns are threaded through the reed assemblies 58,59 with one warp yarn being located in a single dent. For multi-layered weaving several yarns may be located in each dent. For instance for four layered weaving four yarns per dent may be provided. This is schematically illustrated in FIG. 10. The warp yarns reside in the lower reed assemblies and are constrained thereby so as to extend along parallel paths between the front and rear assemblies 58,59.

The healds 53 are located above these paths such that one heald 53 is located directly above one associated path so as to be capable of engaging a warp yarn running along its associated path.

The electronic jacquard mechanism 52 is preferably of the type described in our European (UK) patents 0119787 and 188074 and is operable to raise and lower each heald between a fixed low position LP and a fixed high position HP. This is indicated in FIG. 5.

As seen more clearly in FIGS. 6A, 6B, 6C and 8, each heald 53 is adapted to be detachably connectable to a warp yarn and is preferably in the form of a latch needle. The height LS of the unshedded warp sheet passing between the lower portions of the front and rear reed assemblies 58*b*,59*b* is arranged to be substantially the same as the height LP such that on lowering of the healds 53 to height LP their latches 72 cannot be opened by the associated warp yarn so that the associated yarn remains captive in its hook 73. Thus on setting up of the loom, each warp yarn is threaded through a respective individual heald 53.

Raising of the heald to its height HP now raises the captive warp yarn from its lower shed position (LS) to its upper shed position (US).

Disengagement of warp yarns from their respective healds is achieved using insertable warp yarn disengagement means, preferably in the form of a retractable warp yarn support bar 90. The sequence for disengagement of a warp yarn 11 is illustrated schematically in FIGS. 6A, 6B, 6C. In FIG. 6A a warp yarn 11 has been raised to its upper shed position (US) and thereafter the support bar 90 is inserted across the warp sheet in the weft direction and beneath the raised warp yarn.

The height of the bar 90 is arranged to be at a height (CH) above the clearing height of the needle so that as the heald 53 drops the yarn 11 back towards its lower shed position (LS) (FIG. 6A), the yarn 11 is held at height (CH) by the bar 90 as the needle continues to its low position (LP). At this position, the yarn 11 has cleared the latch 72 so that on raising of the needle towards its high position HP the latch 72 is closed by the yarn 11 thereby enabling the needle to rise without engaging the yarn (FIG. 6C).

In order to re-engage a yarn 11 deposited on the support bar 90 the bar is preferably movable to a lower height position EH whereat a yarn supported thereby is below the clearing height of the latch and is thus engageable with a heald.

Figure 11:
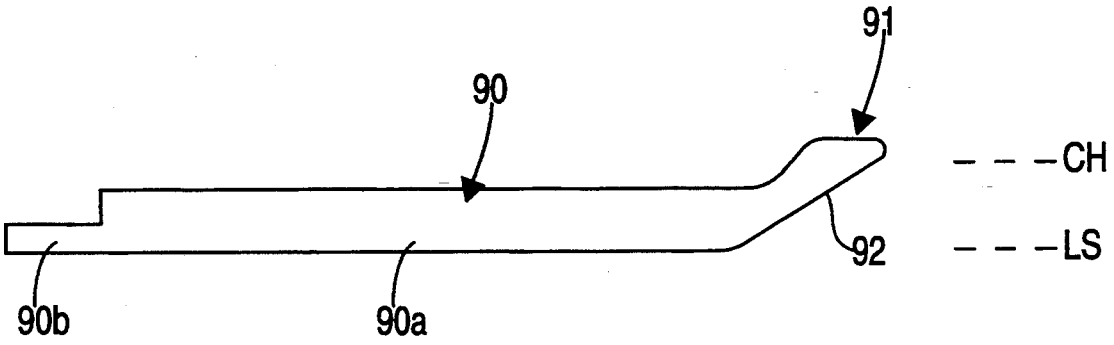
FIG. 11 is a side view of a disengagement bar shown in FIG. 5.

Advantageously, as illustrated in FIGS. 5 and 11 the support bar 90 has a main body portion 90*a* which is cam shaped and is rotatable between a first position (shown in solid lines) whereat yarns are held at height CH and a second position (shown in broken lines) whereat yarns are held at height EH. The bar 90 includes at one end a shaft projection 90*b* via which the bar is rotatably mounted and a nose portion 91 at its other end.

In FIG. 5 the healds are schematically illustrated as being arranged in groups of rows 53A, 53B, 53C, 53D spaced in the warp direction and a disengagement bar 90 is provided for co-operation with each group. The number of groups of rows and co-operating disengagement bars correspond to the number of separate layers to be woven. Thus with the arrangement shown in FIG. 5 four layer weaving is possible.

Raising of warp yarns by the healds 53 to the upper shed position (US) is utilized to achieve two different functions, viz, (i) movement of warp yarns across the warp sheet and (ii) creation of sheds for weft insertion.

Warp Yarn Movement

In the weave of FIG. 1, it is necessary prior to the successive beat-ups to move the group of warp yarns (MWR) to the right and warp yarns (MWL) to the left in order to achieve the diagonal orientation of these yarns. This is represented diagrammatically in FIG. 7. In the sequence illustrated, only the warp yarns (MWL,MWR) of one layer are shown. Initially all warp yarns (MWL,MWR) are raised by associated healds to their upper shed position and so reside in the upper reed portion 58*a*. The disengagement bar is now inserted and the warp yarns (MWL) are lowered to be disengaged from their associated healds and so reside on the disengagement bar at height CH. At this height the yarns (MWL) reside in the lower reed portion 58*b*. This condition is shown in FIG. 7(1).

The upper reed portion 58*a* is now moved to the right by a spacing equivalent to the width of four dents.. This is illustrated by FIG. 7(2).

The warp yarns (MWR) are now lowered to be disengaged by the disengagement bar and so reside at height CH and reside in the lower reed portion 58*b*. The upper reed portion 58*a* is now moved to the left by a spacing equivalent to the width of two dents. At this stage all warp yarns (MWL,MWR) are disengaged. This is illustrated in FIG. 7(3). At this stage, the warp yarns (MWR) have been moved to the right by 4 dent spacings whereas the warp yarns (MWL) have not been moved in the weft direction.

All warp yarns (MWR,MWL) are now moved to height EH by lowering of the engagement bar and all healds are lowered so that all warp yarns (MWR, MWL) are now engaged by their associated healds and are raised into the upper reed portion 58*a*. This is illustrated in FIG. 7(4).

The upper reed portion is now moved to the left by 2 dent spacings to return it to its original position. This is illustrated in FIG. 7(5). At this stage the warp yarns (MWL) have been moved 2 dent spacings to the left of the start position and warp yarns (MWR) have been moved 2 dent spacings to the right of the start position (ie the accumulative effect of moving 4 spacings to the right and then 2 spacings to the left). However, the yarns are not held in the correct heald corresponding with the relevant reed dent. The yarns have therefore to be disengaged and then re-engaged in the correct heald.

Accordingly all warp yarns are now lowered to be disengaged by the disengagement bar at height CH. The warp yarns therefore now reside at height CH and the healds are returned to height HP. This is illustrated in FIG. 7(6). The yarns are then lowered to height EH during which time the warp yarns return (under applied tension) to their parallel relationship between the lower reeds 58*b*,59*b*. The healds are now lowered to re-engage the warp yarns and raise them to their upper shed position US to enable withdrawal of the disengagement bars. This is illustrated in FIG. 7(7).

The disengagement bars are now removed while the yarns (MWR,MWL) are in their upper shed position. Selected yarns may now be lowered to the lower shed position to create a desired shed for weft insertion.

If it is desired to continue the process of moving warp yarns in the weft direction to achieve a desired array, then the disengagement bars are not retracted after the step illustrated in FIG. 7(7). Instead, the disengagement bars are repositioned at height CH so that selected yarns can be lowered and disengaged to repeat the sequence of motions represented by FIGS. 7(1) to 7(7).

This sequence can be repeated any number of times before shedding for weft insertion in order to achieve a desired warp array.

It will be appreciated that since each heald operates independently on individual warp yarns the above procedure can be modified for each individual warp yarn so that prior to shedding for weft insertion any desired number of warp transfers in the weft direction may be undertaken.

As indicated above, when a desired array of warp yarns has been achieved at the step represented by FIG. 7(7), then the disengagement bars are removed and all warp yarns are preferably returned to the lower shed position by lowering of the healds to height LP. Since the disengagement bars have been removed, each individual warp yarn is held captive by an associated individual heald.

During shedding, weft insertion and beat-up, the movable reed portion remains stationary so that the dents of the upper and lower reed are aligned and enable shedding to take place while shedded warp yarns remain captive in aligned dents.

For shedding, selected warp yarns are raised to the upper shed position to create a shed for weft insertion. Normally a single weft insertion operation is performed per shed followed by beat-up. It is envisaged that several weft insertions may be performed in a given shed prior to beat-up so as to lay in several strands of weft yarn. This may occur at any location in the weave and is determined by the strength/shape requirements of the weave. After beat-up, further shed selections may be performed from the warp yarn array. Alternatively a new warp yarn array selection sequence may be initiated.

Multi-Layered Weaving

Figure 9A:
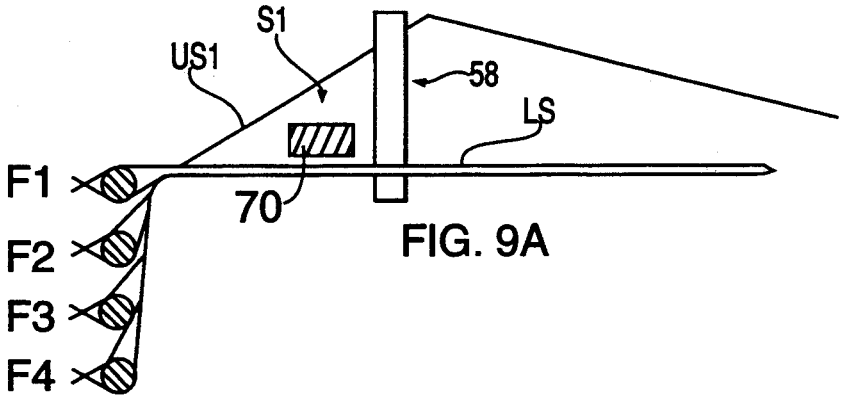
FIGS. 9A and 9B are schematic side view illustrations of use of a single weft insertion rapier for multiple layer weaving.
Figure 9B:
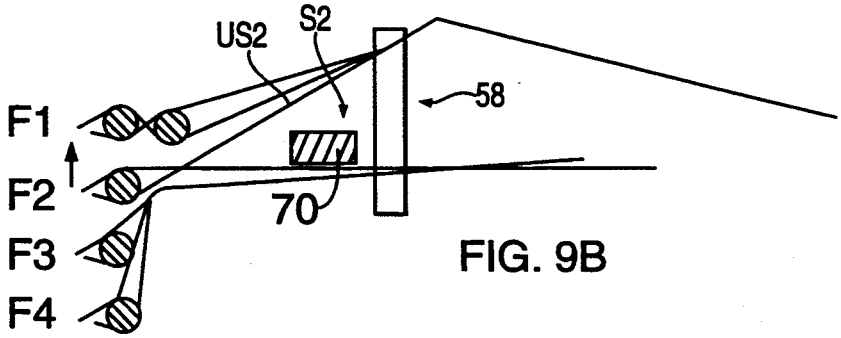

Multi-layered weaving is schematically illustrated in FIGS. 9A,9B.

Selection and movement of warp yarns to define a desired array is achieved in the same manner as described earlier.

Weaving to define different layers is achieved by selective shedding of the warp yarns and appropriate raising or lowering of the weave.

In FIGS. 9(A and B) four layers of fabric F1–F4 are illustrated. In order to weave these layers independently, four independent shedding sequences are required ie one shed for each layer.

In FIG. 9(A) a shed S1 for the first layer F1 is illustrated wherein warp yarns for the upper shed US1 have been raised, the remaining warp yarns being located at the lower shed position LS. One or more weft insertions into shed S1 are now performed followed by beat-up. During shedding, weft insertions and beat-up, fabric F1 is located approximately at level LS.

To weave the next layer F2, the weave is raised to bring layer F2 approximately to the height of level LS. All warp yarns for layer F1 and warp yarns for forming the upper shed US2 of layer F2 are raised to the upper shed position to define shed S2. This is illustrated in broken lines in FIG. 9(B). In this condition, the rapier inserting the weft passes beneath all the warp yarns of the upper fabric layer F1 and is therefore not woven therein.

Weaving of layers F3 and F4 are performed in the same way, ie raising the layer to approximately height LS and raising all warp yarns of the upper fabric layers to the upper shed position.

After weaving of layer F4 the fabric layers are lowered to the position shown in FIG. 9(A) and the sequence is repeated.

Adjacent layers may be interconnected by a weft yarn, by creating a shed for a given layer, and incorporating into the shed selected warp yarns from the adjacent shed.

Similarly, selected warp yarns of a given layer may be incorporated into the warp yarns of another layer for several picks/beat-up operations to thereby interconnect layers by warp yarns.

It will be appreciated that at after beat-up in any one layer of the multi-weave, a warp yarn array selection sequence may be performed to define a new warp yarn array.

In addition, it will be appreciated that weaving in one layer may be performed on successive picks before performing weaving of another layer and that the sequence of weaving between layers F1 to F4 may be selectively performed.

Ward Yarn Movement in Multi-Layer Weaving

As illustrated in FIG. 10, four warp yarns 11A,11B, 11C and 11D are provided in each dent of the reed assemblies 58,59 and these correspond to respective fabric layers F1,F2,F3 and F4 respectively. The warp yarns 11A–11D in each dent are staggered as shown so as to be located at different spaced positions in the weft insertion direction to thereby enable each yarn to be engaged and disengaged by an associated heald.

Initially, all yarns for all layers are raised to the upper shed position US.

The disengagement bar 90(a) is now inserted and the warp yarn movement sequence represented by FIGS. 7(1) to 7(6) are then performed until a desired array of warp yarns 11*a* is obtained.

On completion of the desired sequence on warp yarns 11A, all warp yarns 11A are disengaged from their respective healds in the group 53A and deposited on bar 90(A) at height CH. All healds in group 53*a* are raised to their upper position HT.

During the warp movement sequence of yarns 11*a*, the warp yarns of the other layers remain at their upper shed position and so remain in the same dents in the upper reed portion 58*a* throughout movement of the upper reed portion 58*a*. Accordingly the relative positions of these warp yarns are not affected by the warp movement sequence performed on warp yarns 11A.

In order to perform the warp yarn sequence on the warp yarns 11B of the next layer, the next disengagement bar 90*a* is now inserted. As seen in FIG. 11, each disengagement bar 90 includes a nose portion 91 which is located above height CH and has a lower guide surface 92. Thus on insertion of the disengagement bar 90(*b*) the yarns 11*a* of the previous lay F1 are engaged by the nose portion 91 and are moved by the guide surface 92 to the lower shed position LS. Yarns 11A are therefore located below the disengagement bar 90(*b*) and are unaffected by lowering of the healds of group 53B to their lower position LP.

The yarn movement sequence (FIGS. 7(1) to 7(6) is now performed on yarns 11B to obtain the desired array of warp yarns 11B.

This process of insertion of disengagement bars and performing the yarn movement sequence is repeated for the successive yarns 11C and 11D.

On completion of yarn movement whereby a desired array of warp yarns has been achieved in all layers removal of the disengagement bars is undertaken. This is achieved by initially rotating all disengagement bars so that all yarns are located at EH heights.

The healds in group 53D are then lowered to engage yarns 11D and these yarns are then raised to their upper shed position. Bar 90(*d*) is then removed.

Next, the healds of group 53C are lowered to engage and then raise yarns 11C to the upper shed position. Bar 90(c) is then removed. This sequence is successively repeated for yarns 11B and 11A.

Weaving as described above in relation to FIG. 9 may now be performed.

We claim:

1. A process for weaving warp and weft yarns using a reed having vertically aligned upper and lower reed portions, the reed portions being relatively movable in a weft direction, the process including the steps of:

transferring warp yarns between said reed portions;

moving the transferred warp yarns in the weft direction by relative movement of the reed portions to define a selected array of warp yarns; and shedding the array of warp yarns for insertion of weft yarn.

2. A process according to claim 1, wherein one of said reed portions is stationary and the other is movable in the weft direction, and wherein said steps of transferring warp yarns and moving the transferred warp yarns comprise moving selected individual warp yarns from a given dent in the stationary reed portion into the movable reed portion, moving the movable reed portion in the weft direction by a predetermined spacing, and returning the selected individual warp yarns to a different dent in the stationary reed portion, and repeating this sequence until a desired array of warp yarns is achieved.

3. A process according to claim 2, wherein said step of moving selected individual warp yarns from a given dent in the stationary reed portion into the movable reed portion comprises releasably engaging the individual warp yarns with individual healds.

4. A process according to claim 3, wherein after the step of returning the selected warp yarns to the stationary reed portion, the process comprises the steps of disengaging the healds from the selected warp yarns and re-engaging the healds with newly selected warp yarns either for continuing the sequence for defining a desired array of warp yarns or for creating a selected shed.

5. A process according to any one of claims 1–4, further comprising the step of performing one or more weft insertions for a given shed before a beat-up.

6. A process according to any one of claims 1–4, further comprising the step of performing one or more shed selections from a selected array of warp yarns.

7. A process according to claim 4, wherein each heald is defined by a latch needle, and wherein the step of disengaging a heald from a warp yarn is achieved by supporting the warp yarn at a clearing height in the path of travel of the heald, and wherein the step of re-engaging the heald with a warp yarn is achieved by lowering the warp yarn below the clearing height.

8. A weaving loom head including a reed having vertically aligned upper and lower reed portions, the reed portions being relatively movable in a weft direction;

a plurality of healds each of which includes warp yarn engaging means for releasably engaging an individual warp yarn and for moving selected warp yarns from one reed portion to the other reed portion; and selectively operable drive means for causing relative movement between the reed portions by a predetermined spacing in the weft direction.

9. A weaving loom head according to claim 8, including a front reed and a rear reed each having vertically aligned upper and lower reed portions, and means for moving the reed portions of the front and rear reeds in synchronism in the weft direction so as to maintain the warp yarns in parallel relationship inbetween the front and rear reeds, and wherein said plurality of healds are located inbetween the front and rear reeds.

10. A weaving loom head according to claims 8 or 9, wherein each heald is in the form of a latch needle.

11. A weaving loom head according to claim 10, further comprising means for moving each heald between a lowermost and an uppermost position for moving an associated warp yarn between lower shed and upper shed positions, respectively, and disengagement means for insertion beneath warp yarns raised to the upper shed position, the disengagement means when inserted acting to support warp yarns lowered by the healds at an intermediate height above the lower shed position to enable each warp yarn to clear the warp yarn engaging means of the associated heald when it is at its lowermost position.

12. A weaving loom head according to claim 11, wherein the disengagement means are movably positioned to enable disengaged warp yarns supported thereby to move to a lower position beneath said intermediate position to enable a heald at its lowermost position to engage an associated warp yarn.

13. A weaving loom head according to claims 8 or 9, wherein the lower reed portion of the front reed is stationary in the weft direction, and wherein the loom head includes means for moving the lower reed portion of the front reed in the warp direction for effecting a beat-up.

14. A method of weaving warp yarns with weft yarns in a weaving loom which comprises supply means for supplying in a warp feed direction warp yarns in the form of a warp sheet, weft insertion means at a weft insertion location for inserting in a weft direction weft yarns for weaving with the warp yarns of the warp sheet, reed means which are located between the supply means and the weft insertion location and which include first and second reed portions which are relatively movable in the weft direction from a predetermined first disposition to a predetermined second disposition and which define openings through which the warp yarns pass and in which the warp yarns are held in predetermined spaced positions along the weft direction, the method comprising the steps of:

transferring selected warp yarns from predetermined openings in the first reed portion to openings in the second reed portion;

bringing the reed portions from the first disposition to the second disposition to move the transferred warp yarns in the weft direction to produce a transferred array of warp yarns; and shedding the transferred array of warp yarns for insertion of weft yarn.

15. A weaving loom for weaving warp yarns with weft yarns comprising:

warp yarn supply means for supplying in a warp feed direction warp yarns in the form of a warp sheet;

weft insertion means at a weft insertion location for inserting in a weft direction weft yarns for weaving with the warp yarns of the warp sheet;

reed means located between the supply means and the weft insertion location and including first and second reed portions which are relatively movable in the weft direction from a predetermined first disposition to a predetermined second disposition;

said reed portions defining openings through which the warp yarns pass and in which they are held in predetermined spaced positions along the weft direction;

warp yarn transfer means for transferring selected warp yarns from predetermined openings in the first reed portion to openings in the second reed portion;

drive means to bring the reed portions from the first disposition to the second disposition to move the transferred warp yarns in the weft direction to produce a transferred array of warp yarns; and shedding means to shed the transferred array of warp yarns for insertion of weft yarn.

* * * * *